US005947295A

United States Patent [19]

Lutin

[11] Patent Number: 5,947,295

[45] **Date of Patent: *Sep. 7, 1999**

[54] LINER DISPENSER FOR WASTE CONTAINERS

[76] Inventor: Matthew Lutin, 6936 Quiet Cove Dr., Carlsbad, Calif. 92009

[ * ] Notice: This patent issued on a continued prosecution application filed under 37 CFR 1.53(d), and is subject to the twenty year patent term provisions of 35 U.S.C. 154(a)(2).

[21] Appl. No.: 08/629,998

[22] Filed: Apr. 8, 1996

[51] Int. Cl.[6] ..... B65D 1/34

[52] U.S. Cl. ..... 206/554; 206/812; 220/4.24; 220/407

[58] Field of Search ..... 206/493, 554, 206/477, 812; 220/403, 404, 407, 908, 293, 297, 298, 4.21, 4.24, 4.25, 796, 677

[56] References Cited

U.S. PATENT DOCUMENTS

| | | | |
|---|---|---|---|
| 3,010,673 | 11/1961 | Marconi | 220/298 |
| 3,300,082 | 1/1967 | Patterson . | |
| 3,313,504 | 4/1967 | Stoltz . | |
| 3,451,453 | 6/1969 | Heck . | |
| 3,481,112 | 12/1969 | Bourgeois . | |
| 3,709,397 | 1/1973 | Daenen | 220/796 |
| 3,800,503 | 4/1974 | Maki . | |
| 4,106,617 | 8/1978 | Boone | 206/812 |
| 4,171,047 | 10/1979 | Doyle et al. . | |
| 4,219,129 | 8/1980 | Sedgwick . | |
| 4,235,333 | 11/1980 | Boone | 206/812 |
| 4,349,123 | 9/1982 | Yang . | |
| 4,364,490 | 12/1982 | Lang et al. . | |
| 4,516,688 | 5/1985 | Freeland | 220/293 |
| 4,792,087 | 12/1988 | Russell | 220/293 |
| 4,798,363 | 1/1989 | Cortesi . | |
| 4,805,800 | 2/1989 | Nocek et al. . | |
| 4,850,507 | 7/1989 | Lemongelli et al. . | |
| 4,850,508 | 7/1989 | Lee . | |
| 4,869,391 | 9/1989 | Farrington . | |
| 4,955,505 | 9/1990 | Batttaglia . | |
| 5,000,340 | 3/1991 | Leggio . | |
| 5,115,935 | 5/1992 | Lemongelli . | |
| 5,183,157 | 2/1993 | Darden | 220/407 |
| 5,353,950 | 10/1994 | Taylor et al. . | |
| 5,356,023 | 10/1994 | Krupa | 220/4.21 |
| 5,405,041 | 4/1995 | Van Brackle . | |
| 5,503,288 | 4/1996 | Conconi | 220/4.21 |
| 5,547,109 | 8/1996 | Robbins, III | 220/254 |
| 5,671,847 | 9/1997 | Pedersen et al. . | |

OTHER PUBLICATIONS

Accrafect Products, Inc.: *The Glove Canister*: one page information sheet.

*Primary Examiner*—Paul T. Sewell
*Assistant Examiner*—Nhan T. Lam
*Attorney, Agent, or Firm*—Samuel Shipkovitz; Cohen Smith

[57] ABSTRACT

A liner dispenser for a waste container having a waste container floor and a waste container side wall with an upper rim, for removably securing to the waste container floor, includes a cylindrical and substantially rigid dispenser shell having a shell side wall, a shell top wall with a liner dispensing opening and a shell bottom wall which forms a lower corner with the shell side wall, and which is bowed outwardly to present a convex surface to abut the waste container floor and elevate the lower corner for ease of grasping with user finger tips during dispenser removal, and a device for removably securing the shell bottom wall to the waste container floor. The liner dispenser preferably additionally includes several interconnected waste container liners enclosed within the dispenser shell, each liner having a liner closed end and a liner open end. The shell top wall is preferably bowed outwardly to present a concave inner surface to the waste container liners enclosed within the dispenser shell to funnel the liners to and through the dispensing opening. The device for removably securing the shell bottom wall to the waste container floor includes an anchor member for securing to the waste container floor with an anchor member securing structure, the anchor member having an anchor member engaging structure for removably engaging a corresponding dispenser shell engaging structure in the shell bottom wall.

13 Claims, 4 Drawing Sheets

LINER DISPENSER FOR WASTE CONTAINERS

BACKGROUND OF THE INVENTION

1. Field of the Invention:

The present invention relates generally to the field of waste container liners. More specifically the present invention relates to a disposable liner dispenser which is removably secured to the floor of a waste container. The dispenser includes a cylindrical shell which, when mounted, has a vertical shell side wall, a shell top wall and a shell bottom wall. The shell top wall has a central dispensing opening. The shell top wall is preferably bowed upwardly to present a concave surface to the liners inside the dispenser to help funnel the liners to and through the dispensing opening. The shell side wall is preferably a double wall formed of an outer side wall extending downwardly from the shell top wall and an inner side wall extending upwardly from the shell bottom wall. The inner and outer side walls are sized to slide snugly against each other to create a firm friction engagement. The shell bottom wall is preferably bowed downwardly so that a convex surface approaches the waste container floor. This configuration elevates the lower corner of the shell side wall for ease of grasping with finger tips during dispenser removal. The liners are interconnected in a series for sequential dispensing.

2. Description of the Prior Art:

There have long been liners for waste containers to keep the containers clean and to provide a vessel for removal of waste from the containers. A number of product designers in the industry have recognized the inconvenience of storing liners in boxes separate from the container. One must walk to the liner box location, find the liner box, and bring a liner back to the waste container. Sometimes janitors and homeowners grow weary of and omit this task, resulting in sticky, germ-breeding waste being dumped directly into an unlined container, causing the container to become caked and unsanitary with noxious residue. These product designers have seen the advantages of providing a liner dispenser at the waste container floor, to sequentially dispense interconnected liners directly into the container, thereby eliminating the need of bringing them from another location. These dispensers have generally fallen into two categories: the type removably secured to the floor of an existing waste container floor, and the type manufactured into the waste container floor.

Leggio, U.S. Pat. No. 5,000,340, issued on Mar. 19, 1991, teaches dispenser of the first category in the form of a cylindrical shell anchored horizontally to a waste container floor, such as with hook and loop fasteners. A roll of interconnected liners is dispensed through an opening in the tubular side wall of the shell. A problem with Leggio is that the shape and orientation of the cylindrical shell predisposes it to rolling movement, and the impact of waste items dropped into a deployed liner could laterally dislodge the shell from the floor fastener. Another problem with Leggio is that dispensing liners from the outside of the roll requires that the roll rotate about its axis during dispensing. This causes friction and drag within the shell, which could dislodge the shell from the container floor. Still another problem with Leggio is that its bulky size takes up trash space.

Taylor, et al., U.S. Pat. No. 5,353,950, issued on Oct. 11, 1994, teaches a collapsible pouch liner dispenser removably secured to the waste container floor with adhesive tape. A problem with Taylor, et al., is that the soft pouch dispenser is likely to tear with rough handling. Another problem is that the Taylor, et al. pouch would not fit into many smaller dispenser containers because of its size and shape. That is, a square pouch will not fit well into a small round container.

Darden, U.S. Pat. No. 5,183,157, issued on Feb. 2, 1993, teaches a dispenser box having a slotted top wall, stated to be lying or resting on the floor of a trash can and containing an interconnected string of liners. The last liner in the string is connected to a plate within the dispenser box which abuts the top wall around the slot to pull the empty dispenser box out of the trash can with the last liner. A problem with Darden is that the dispenser is wide and bulky.

The other category of dispenser, manufactured into the waste container floor, presents several disadvantages. One disadvantage is that the user must discard otherwise functional existing waste containers to purchase entirely new ones so equipped. Another disadvantage is that, should the dispenser become damaged or otherwise inoperable, the entire waste container must be replaced.

Such dispensers are disclosed several prior patents. Van Brackle, U.S. Pat. No. 5,405,041, issued on Apr. 11, 1995, teaches a trash liner pail having a pail floor with a central recess into which liners are placed, and a removable dispenser cover which has a dispensing slot and fits over the recess.

Yang, U.S. Pat. No. 4,349,123, issued on Sep. 14, 1982, teaches a garbage can with a slotted bottom wall and retaining brackets extending downwardly from the bottom wall for receiving a liner dispenser box with a registering slot.

Heck, U.S. Pat. No. 3,451,453, issued on Jun. 24, 1969, teaches a waste receptacle with a receptacle floor, and with a slotted false bottom member spaced above the floor by legs and sized to closely fit to the receptacle side walls, for retaining and dispensing liners sequentially into the waste receptacle.

Lemongelli, U.S. Pat. No. 5,115,935, issued on May 26, 1992, teaches a trash receptacle with a receptacle floor having a downwardly extending cavity for receiving a liner dispensing box.

Lemongelli, et al., U.S. Pat. No. 4,850,507, issued on Jul. 25, 1989, teaches a trash receptacle having a receptacle floor with a central port for receiving a liner dispensing box.

Farrington, U.S. Pat. No. 4,869,391, issued on Sep. 26, 1989, teaches a liner roll rotatably mounted onto a holding structure secured to the container floor, and alternatively teaches a waste container enclosing a stack of liners, each liner containing a removable insert sized to snugly fit against the walls of the waste container to hold the liners in place until each is used.

Other patents issuing for in-floor dispenser structures include Cortesi, U.S. Pat. No. 4,798,363, issued on Jan. 17, 1989; Patterson, U.S. Pat. No. 3,300,082, issued on Jan. 24, 1967; Battaglia, U.S. Pat. No. 4,955,505, issued on Sep. 11, 1990; Maki, U.S. Pat. No. 3,800,503, issued on Apr. 2, 1974; Yurks, U.S. Pat. No. 4,721,226, issued on Jan. 26, 1988; Lang, et al., U.S. Pat. No. 4,364,490, issued on Dec. 2, 1982; and Bourgeois, U.S. Pat. No. 3,481,112, issued on Dec. 2, 1969.

Finally, several types of wet tissue dispensers have been developed over the years. These include Stoltze, U.S. Pat. No. 3,313,504, issued on Apr. 11, 1967; Lee, U.S. Pat. No. 4,850,508, issued on Jul. 25, 1989; Nocek, et al., U.S. Pat. No. 4,805,800, issued on Feb. 21, 1989; Sedjwick, U.S. Pat. No. 4,219,129, issued on Aug. 26, 1980; Doyle, et al., U.S.

Pat. No. 4,171,047, issued on Oct. 16, 1979. A problem with these dispensers is that there is no teaching or provision for dispensing liners into a waste container.

It is thus an object of the present invention to provide a disposable liner dispenser for a waste container which removably mounts to the waste container floor for convenient liner deployment.

It is another object of the present invention to provide such a disposable dispenser which smoothly funnels the liners through a dispensing opening at the top of the dispenser.

It is still another object of the present invention to provide such a disposable dispenser which is easily grasped by the user for removal and replacement.

It is finally an object of the present invention to provide such a disposable dispenser which is compact, durable, easy to replace and relatively inexpensive to manufacture.

SUMMARY OF THE INVENTION

The present invention accomplishes the above-stated objectives, as well as others, as may be determined by a fair reading and interpretation of the entire specification.

A liner dispenser is provided for a waste container having a waste container floor and a waste container side wall with an upper rim, for removably securing to the waste container floor, including a cylindrical and substantially rigid dispenser shell having a shell side wall, a shell top wall with a liner dispensing opening and a shell bottom wall which forms a lower corner with the shell side wall, and which is bowed outwardly to present a convex surface to abut the waste container floor and elevate the lower corner for ease of grasping with user finger tips during dispenser removal, and a device for removably securing the shell bottom wall to the waste container floor.

The liner dispenser preferably additionally includes several waste container liners enclosed within the dispenser shell, each liner having a liner closed end and a liner open end. The waste container liners are preferably removably interconnected in a series for sequential dispensing through the dispensing opening, so that the closed end of each liner, from the first to the next to last in the series, is connected to the open end of a subsequent liner in the series. The shell top wall is preferably bowed outwardly to present a concave inner surface to the waste container liners enclosed within the dispenser shell to funnel the liners to and through the dispensing opening. The liner dispenser preferably additionally includes a knock-out disk removably secured within the dispensing opening. The shell side wall is preferably a double wall formed of an outer side wall extending downwardly from the shell top wall and an inner side wall extending upwardly from the shell bottom wall, so that the inner and outer side walls are sized to slide snugly against each other when the dispenser shell is fitted together, to create a friction engagement. Alternatively the inner and outer side walls may be glued together or manufactured as a single piece. The device for removably securing the shell bottom wall to the waste container floor optionally includes hook and loop fasteners. The device for removably securing alternatively includes a resilient pad such as double sided sticky foam tape secured to the dispenser bottom wall and to the waste container floor. The device for removably securing the shell bottom wall to the waste container floor still alternatively and preferably includes an anchor member for securing to the waste container floor with an anchor member securing structure, the anchor member having an anchor member engaging structure for removably engaging a corresponding dispenser shell engaging structure in the shell bottom wall. The anchor member is a preferably disk member and the anchor member engaging structure preferably includes a progressively tapered flange protruding radially from the disk member, and the dispenser engaging structure includes a disk member port having port edges and having flange receiving notches cut into the port edges, the port edges between the notches being tapered so that, once the flanges pass through the notches, rotation of the dispenser shell in one direction relative to the disk member wedges the flanges and the port edges together, and rotation of the dispenser shell in the other direction relative to the disk member disengages the flanges and the port edges and aligns the flanges with the notches so that the dispenser can be lifted off the disk member and out of the waste container.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
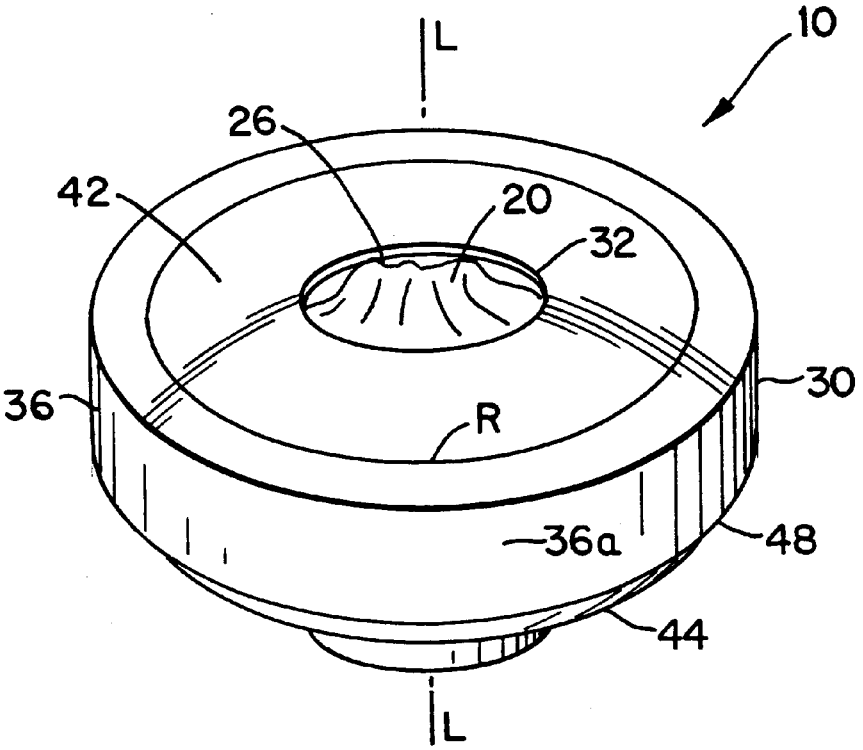
FIG. 1 is a perspective view of the inventive dispenser, with one of the liners being visible through the dispensing opening. A circular reinforcing ridge R is provided on the top wall.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–8, a disposable liner dispenser 10 is disclosed which is removably secured to the floor 12 of a waste container 14.

The liners 20 are flexible bags which are interconnected in a series for sequential dispensing. Each liner 20 has a closed end 22 which is connected by a perforated segment 24 to an open end 26 of the next liner 20 in the series, except for the last liner 20 which rests in the bottom of dispenser 10. Liners 20 are coiled, stacked or otherwise compactly arranged within dispenser 10. A first liner 20 is pulled through an opening 32 in the dispenser 10, open end 26 first, and open end 26 is turned down over the container side wall 16 upper rim in a conventional way. See FIGS. 1 and 2. The closed end 22 of the deployed liner 20 remains attached to the open end 26 of a second liner 20 still within dispenser 10. When the first liner 20 is eventually filled with trash or other items, the open end 26 is brought together and tied closed. As the first liner is lifted out of waste container 14, the second liner 20 is pulled upwardly within container 14 by a perforated segment 24. Then the first liner 20 is torn free of the second liner 20 along the perforations, and the second liner open end 22 is turned down over the container side wall 16 upper rim. A succession of liners 20 is thus dispensed and deployed within waste container 14, filled, discarded and automatically replaced until the dispenser 10 is empty. Empty dispenser 10 is then removed from container floor 12 and replaced with a full dispenser 10.

Figure 1A:
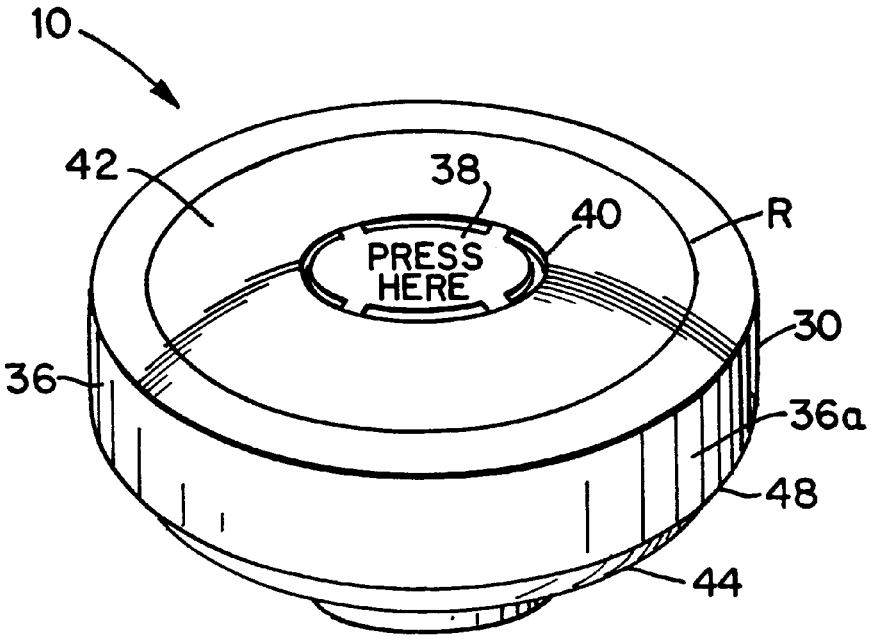
FIG. 1*a* is a perspective view of the dispenser of FIG. 1 with the knock-out disk still in place.
Figure 2:
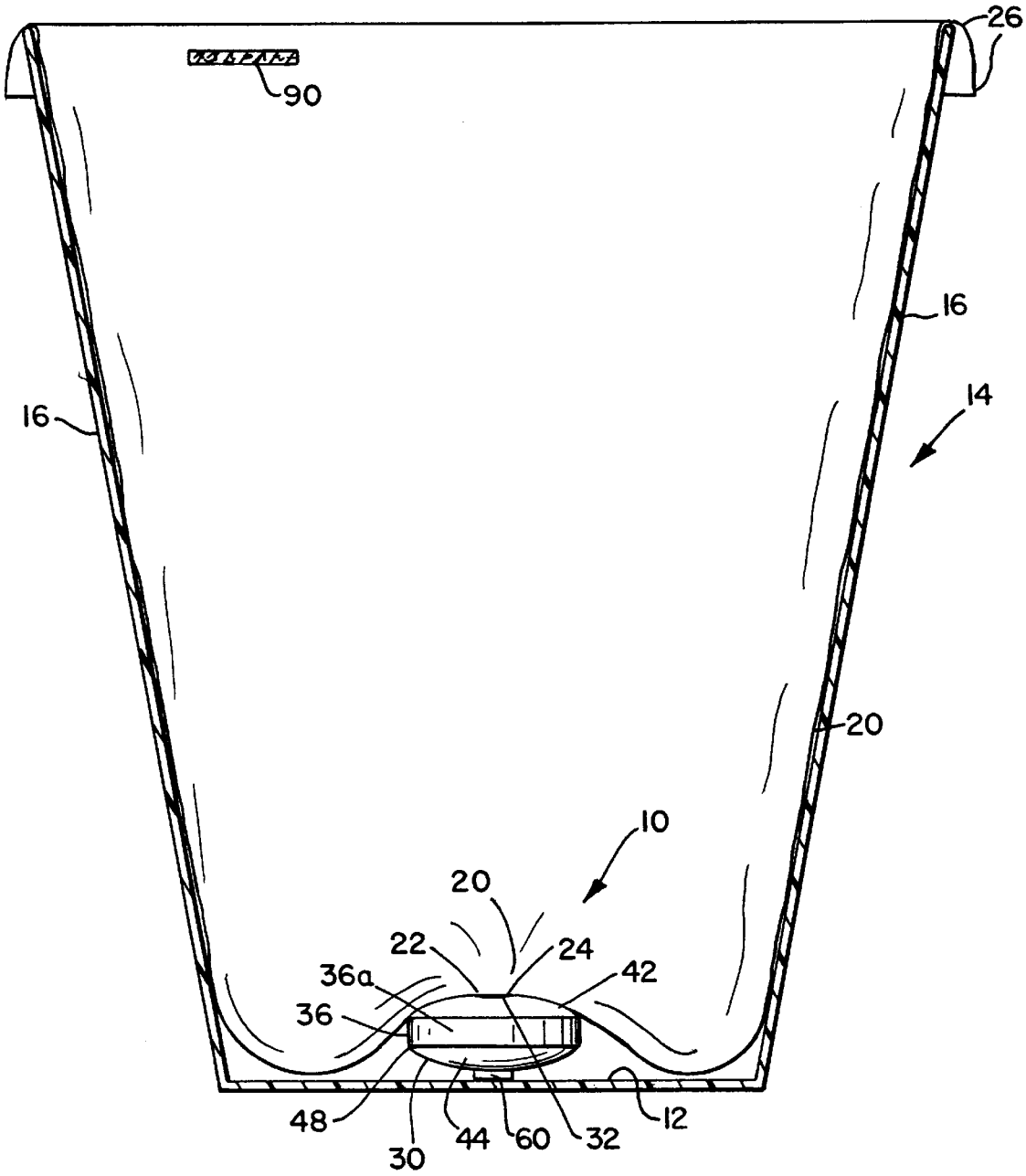
FIG. 2 is a cross-sectional side view of a waste container having a dispenser secured to the container floor and a liner deployed from the dispenser and doubled over the container side wall upper rim.
Figure 3:
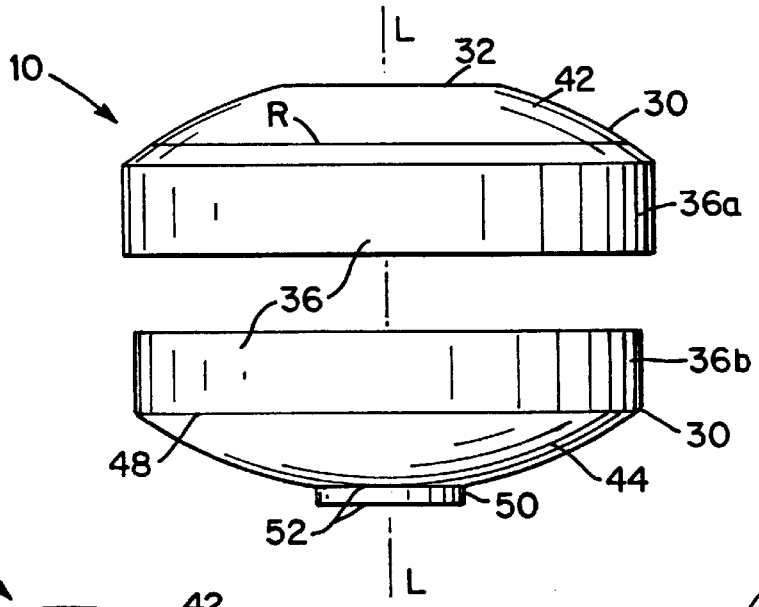
FIG. 3 is a side view of an opened dispenser, showing the overlapping double side walls.
Figure 4:
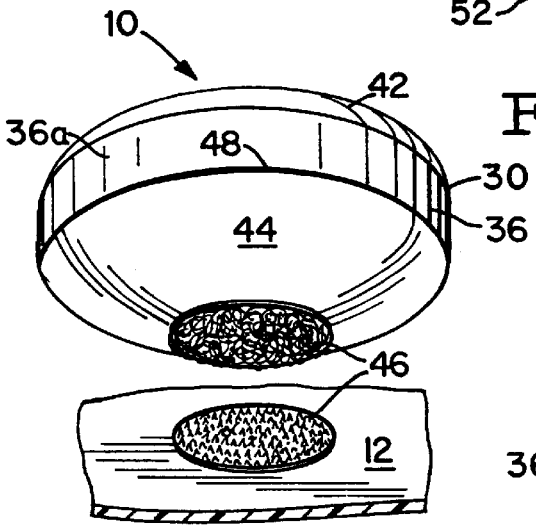
FIG. 4 is a lower, perspective view of a dispenser having a circular patch of hook or loop fastener material secured to the bottom wall and a corresponding patch of loop or hook fastener material secured to a waste container floor, for mounting the dispenser.
Figure 5:
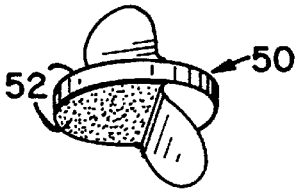
FIG. 5 is a perspective view of a resilient pad with double-sided tape on both pad faces, and an adhesive shield being pulled back from each face to reveal the tape adhesive. The resilient pad may take the form of double sided foam tape attached directly to the shell bottom wall.
Figure 6:
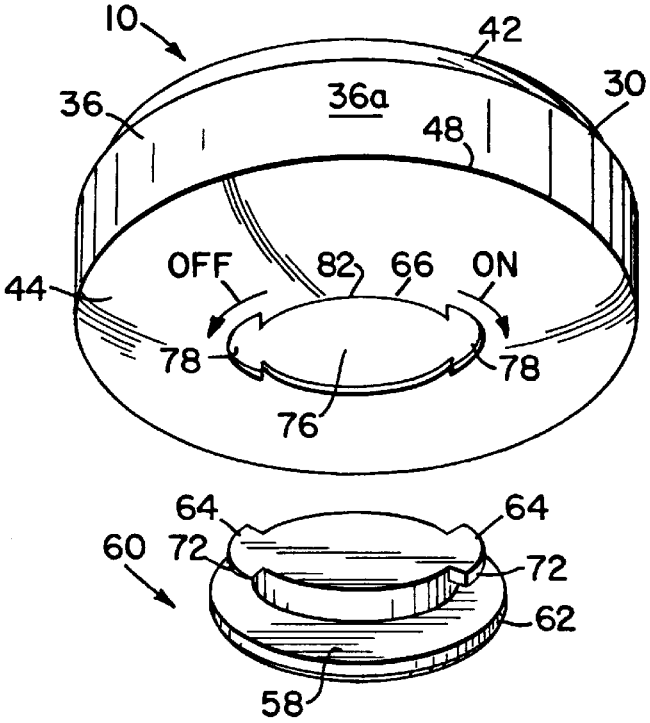
FIG. 6 is a perspective view of the dispenser having the preferred anchor member and locking structure securing means, showing the wedge shape of the flanges and the flange receiving notches in the bottom wall.
Figure 7:
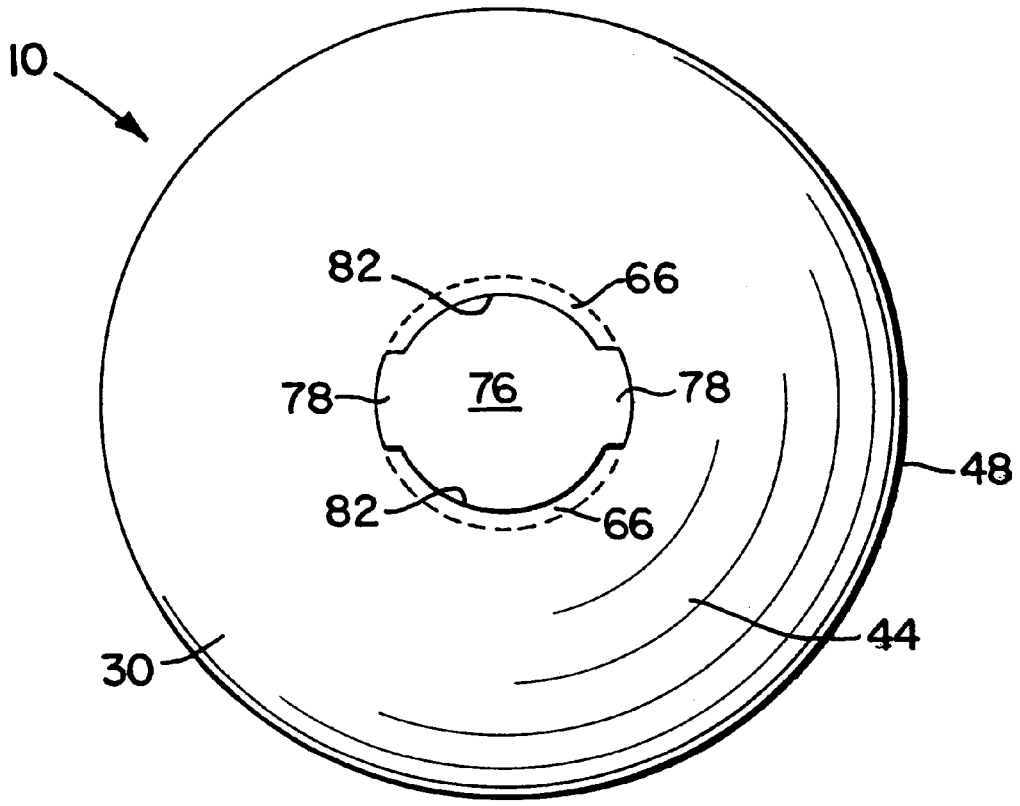
FIG. 7 is a bottom view of the dispenser having the anchor member securing means, showing the disk member port, the port edges, the flange receiving notches and a wedged surface along the port edge for making wedging engagement with the flanges.
Figure 8:
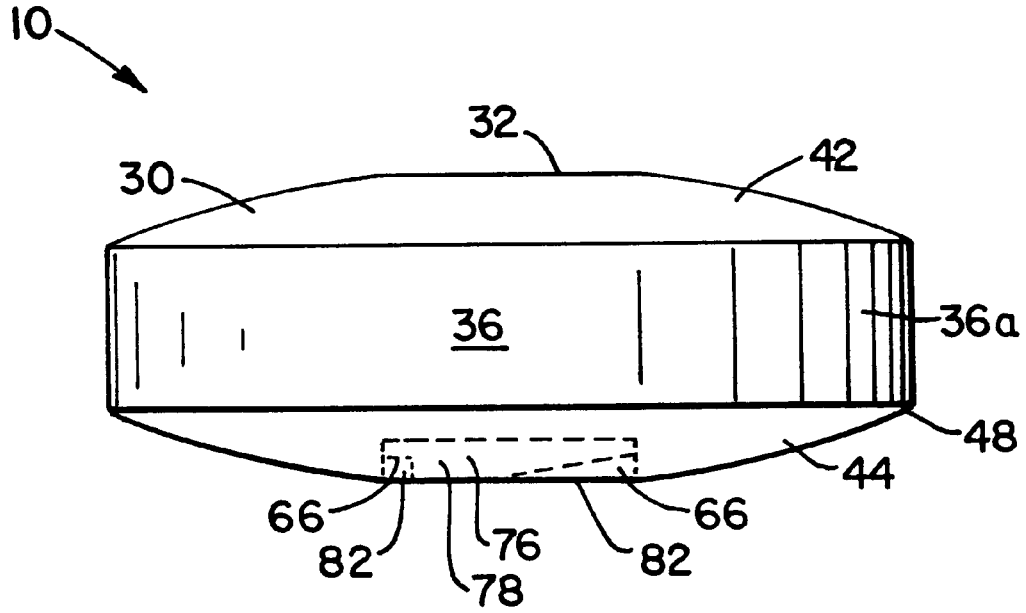
FIG. 8 is a side view of the dispenser showing a preferred wedged surface shape inside the bottom wall along the port edges.

Dispenser 10 includes a substantially rigid, cylindrical shell 30 which, when mounted, has a vertical central axis L and a vertical shell side wall 36, a shell top wall 42 and a shell bottom wall 44. Shell top wall 42 includes the central dispensing opening 32, which is preferably circular. See FIG. 1. A knock-out disk 38 preferably fills dispensing opening 32 until the dispenser 10 is mounted for use, and is then punched out of opening 32 along a stress riser groove 40 along the disk perimeter. See FIG. 1*a*. Shell top wall 42 is preferably bowed upwardly to present a concave surface to the liners 20 inside the dispenser 10 to help funnel the liners 20 to and through dispensing opening 32.

Shell side wall 36 is preferably a double wall. See FIG. 3. It is formed of an outer side wall 36*a* extending downwardly from shell top wall 42 and an inner side wall 36*b* extending upwardly from shell bottom wall 44. Inner and outer side walls, 36*a* and 36*b* respectively, are diametrically sized to slide snugly against each other when shell 30 is fitted together, to create a firm friction engagement.

Shell bottom wall 44 is bowed downwardly so that a convex outer surface abuts the waste container floor 12. This configuration elevates the lower corner 48 of shell side wall 36 for ease of grasping with finger tips during dispenser 10 removal. Shell bottom wall 44 may be secured to the waste container floor 12 with hook and loop fasteners 46, the hook or loop portion being glued to container floor 12. See FIG. 4. Alternatively, a resilient pad 50 fitted on both of its faces with double-sided tape 52 is secured to shell bottom wall 44, so that an empty dispenser 10 is simply pulled off container floor 12, pad 50 and all, and a full dispenser 10 taped to floor 12 in its place. See FIG. 5.

Still alternatively, a separate anchor member 60 is secured to the waste container floor 12, such as with double-sided tape or with glue 62. See FIGS. 6–8. An anchor member engaging structure 64 removably engages a corresponding dispenser engaging structure 66 in shell bottom wall 44. The preferred anchor member 60 is essentially a disk with a circular base plate 58 and the engaging structure 64 preferably includes progressively tapered opposing flanges 72 protruding radially from the disk anchor member 60. The dispenser engaging structure 66 in this instance includes an anchor member port 76 sized to receive the disk anchor member 60 and having opposing flange receiving notches 78 cut into port edges 82. The remaining port edges 82 between notches 78 are preferably tapered so that, once flanges 72 pass through notches 78, rotation of dispenser 10 in one direction relative to anchor member 60 wedges port edges 82 between flanges 72 and base plate 58, or otherwise wedges port edges 82 and flanges 72 together. Rotation of dispenser 10 in the other direction relative to anchor member 60 disengages flanges 72 from port edges 82 and aligns flanges 72 with notches 78 so that dispenser 10 may be lifted off anchor member 60.

Dispenser 10 is optionally scented to help mask any unpleasant odors emanating from waste within the open liner 20, and may also include a disinfectant to sanitize the waste container 14. Dispenser 10 is preferably made of biodegradable materials, which may take the form of a suitable plastic. One to three dispensers 10 may be sold together in a single package, which may also include disposable plastic gloves for installation. Several sizes of dispensers 10 may be provided for holding liners 20 of various sizes, suitable for bath trash containers 14, kitchen trash containers 14 and outdoor home or commercial trash cans 14 such as for fast food chains may be provided.

Shell 30 may alternatively have a square, rectangular, oblong or other geometric shape. Liners 20 may be packed in a vertical accordion or in a horizontal accordion configuration.

Dispenser 10 preferably includes an indicator 90 to alert the user that it is about to run out of liners 20. Indicator 90 can be in the form of printed numbers on liners 20 in descending order, so that the number "1" is printed on the last liner 20 in dispenser 10. Alternatively the indicator 90 can be a printed marker such as a red line printed on the last few liners 20, such as the last three to five liners 20 in dispenser 10. The indicator 90 may be a horizontal or vertical line, or a marker of any other shape.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A compact liner dispenser for a waste container having a waste container floor and a waste container side wall with an upper rim, comprising:

a substantially rigid dispenser shell having a shell top wall, bottom wall, and side wall, wherein said side wall has a cross section defining an outer contour of said shell so as to further define a central axis of said liner dispenser, said central axis extending upwardly through and substantially normal to said contour and intersecting said top wall and said bottom wall, wherein said shell has a height which is substantially less than its largest width, wherein said shell top wall includes a liner dispensing opening such that said liner dispensing opening is substantially centrally located at approximately the intersection of said central axis and said top wall, and wherein said shell bottom wall forms a lower corner with said shell side wall, and is bowed outwardly to present a convex surface to abut said waste container floor and elevate said lower corner for ease of grasping with user finger tips during dispenser removal;

a plurality of waste container liners wound compactly into a coil of limited height so as to fit within said shell, wherein one of said waste container liner which is at the interior of said coiled plurality of waste container liners has a portion located proximate to said central axis and away from said shell side wall, and is positioned so that pulling said portion pulls said liner through said liner dispenser opening; and said shell bottom wall additionally comprising a mounting device situated approximately at the intersection of said central axis and said shell bottom wall for removably securing said shell bottom wall to said waste container floor.

2. A liner dispenser according to claim 1, wherein said shell top wall is bowed outwardly to present a concave inner surface to said waste container liners enclosed within said dispenser shell to funnel said liners to and through said dispensing opening.

3. A liner dispenser according to claim 1, additionally comprising a knock-out disk removably secured within said dispensing opening.

4. A liner dispenser according to claim 1, wherein said shell side wall is a double wall formed of an outer side wall extending downwardly from said shell top wall and an inner side wall extending upwardly from said shell bottom wall, such that said inner and outer side walls are sized to slide snugly against each other when said dispenser shell is fitted together, to create a friction engagement.

5. A liner dispenser according to claim 1, wherein said means for removably securing said shell bottom wall to said waste container floor comprises hook and loop fastener means.

6. A liner dispenser according to claim 1, wherein said means for removably securing comprises double-sided sticky foam tape secured to said dispenser bottom wall and to said waste container floor.

7. A liner dispenser according to claim 1, wherein said mounting device for removably securing said shell bottom wall to said waste container floor comprises a separate anchor member for securing to said waste container floor, wherein said anchor member is adapted to removably engage a corresponding dispenser shell engaging structure in said shell bottom wall.

8. A liner dispenser according to claim 7, wherein said anchor member is a disk member which includes a progressively tapered flange protruding radially from said disk member, and wherein said dispenser shell engaging structure includes a disk member port having port edges and having flange receiving notches cut into said port edges, said port edges between said notches being tapered such that, once said flanges pass through said notches, rotation of said dispenser shell in one direction relative to said disk member engages said flanges and said port edges together so as to secure said liner dispenser to said anchor member, and rotation of said dispenser shell in the other direction relative to said disk member disengages said flanges and said port edges and aligns said flanges with said notches such that said dispenser can be lifted off said disk member and out of said waste container.

9. A liner dispenser according to claim 1, wherein at least one liner comprises a marker indicating that said dispenser is approximately depleted of liners.

10. A liner dispenser according to claim 9, wherein said marker comprises a printed line extending along at least the last two liners in said series.

11. A liner dispenser according to claim 9, wherein said series of liners is sequentially numbered.

12. A waste container liner dispenser, said container having a waste container floor, said floor having a securing means, said dispenser comprising:

a shell having a top wall, a bottom wall, and a side wall separating said top wall from said bottom wall, said shell walls defining a flat cylinder having a longitudinally extending central axis extending upwardly through and intersecting said top wall and said bottom wall, wherein said shell has a height which is substantially less than its diameter;

a substantially circular liner dispenser opening in said top wall, said liner dispensing opening being situated in said top wall at approximately the intersection of said central axis and said top wall;

a series of liners, wound compactly into a coil of limited height so as to fit within said shell, said coil having an exterior circumference and an interior wherein the interior, of said coil is adjacent to said liner dispenser opening; said series of liners being singly sequentially removed from said coil through said dispenser opening by extracting each liner of said series from the interior of said coil; and a mounting device located on said bottom wall wherein said mounting device removably secures said shell bottom wall to said waste container floor.

13. A waste container liner dispenser comprising:

a shell having a top wall, a bottom wall, and a side wall separating said top wall from said bottom wall, wherein said side wall has a cross section defining an outer contour of said shell so as to further define a central axis of said liner dispenser, said central axis extending upwardly through and substantially normal to said contour and intersecting said top wall and said bottom wall, and wherein said shell has a height which is substantially less than the largest width;

a liner dispenser opening in said top wall, said liner dispenser opening being substantially centrally located in said top wall at approximately the intersection of said central axis at said top wall; and a series of liners wound compactly into a coil of limited height so as to fit within said shell, said coil having an exterior circumference and an interior, wherein the interior of said coil is adjacent to said liner dispenser opening, said series of liners being singly sequentially removed from said coil through said dispenser opening by extracting each liner of said series from the interior of said coil.

* * * * *